US008333428B2

(12) United States Patent
Zhu et al.

(10) Patent No.: US 8,333,428 B2
(45) Date of Patent: Dec. 18, 2012

(54) FOLDABLE CHAIR WITH SIDE TABLE

(76) Inventors: Shou Qiang Zhu, Wanchai (HK); Edward Zheng, Wanchai (HK)

( * ) Notice: Subject to any disclaimer, the term of this patent is extended or adjusted under 35 U.S.C. 154(b) by 254 days.

(21) Appl. No.: 12/661,709

(22) Filed: Mar. 22, 2010

(65) Prior Publication Data

US 2011/0227374 A1 Sep. 22, 2011

(51) Int. Cl.

| | |
|---|---|
| ***A47B 83/02*** | (2006.01) |
| ***A47C 4/28*** | (2006.01) |
| ***A47C 1/02*** | (2006.01) |
| ***A47C 7/62*** | (2006.01) |

(52) U.S. Cl. ..... 297/144; 297/35; 297/46; 297/81; 297/188.11

(58) Field of Classification Search ..... 297/46, 297/16.1, 35, 135, 144, 188.11, 188.08, 188.21, 297/188.15, 188.01, 80, 81

See application file for complete search history.

(56) References Cited

U.S. PATENT DOCUMENTS

| | | | | |
|---|---|---|---|---|
| 2,372,077 | A * | 3/1945 | Glinecki | 297/156 |
| 3,399,925 | A * | 9/1968 | Levy | 297/156 |
| 4,061,395 | A * | 12/1977 | Boole | 297/188.11 |
| 5,524,957 | A * | 6/1996 | Gibriano | 297/144 |
| 5,586,806 | A * | 12/1996 | Hergott | 297/188.11 |
| 6,042,180 | A * | 3/2000 | Lombardi | 297/188.11 |
| 6,145,931 | A * | 11/2000 | Subotic | 297/423.2 |
| 6,227,615 | B1 * | 5/2001 | Newhouse et al. | 297/188.11 |
| 7,185,948 | B2 * | 3/2007 | Liu | 297/30 |
| 2011/0193372 | A1 * | 8/2011 | Pizzuto | 297/16.1 |

* cited by examiner

*Primary Examiner* — Milton Nelson, Jr.

(57) ABSTRACT

A foldable chair includes a seat frame, a leg frame and a side accessory arrangement. The side accessory arrangement includes a sliding frame provided on the leg frame at a position underneath the seat frame, and a side accessory coupled with the sliding frame, and is arranged to slide between an idle position and an operation position when the leg frame is in the unfolded position, wherein in the idle position, the side accessory is inwardly slid with respective to the leg frame through the sliding frame to hide in the receiving cavity, wherein in the operation position, the side accessory is outwardly slid from the receiving cavity with respective to the leg frame through the sliding frame for allowing a user to put an object on the side accessory.

17 Claims, 4 Drawing Sheets

FOLDABLE CHAIR WITH SIDE TABLE

BACKGROUND OF THE PRESENT INVENTION

1. Field of Invention

The present invention relates to a chair, and more particularly to a foldable chair comprising a side accessory arrangement in which a side accessory is capable of sliding from underneath a seat frame for supporting an accessory object.

2. Description of Related Arts

A foldable chair usually comprises a seat frame supporting a seat fabric thereon, a back frame upwardly extended from the seat frame for supporting a back portion of a user, and a leg frame downwardly and foldably extended from the seat frame to act as a support for the entire foldable chair as well as the user. Usually, the leg frame is foldable so as to allow the user to reduce the entire foldable chair into a compact size when it is not in use. A major disadvantage of such foldable chair is that it is very difficult for a manufacturer to install an accessory, such as a side table, onto the foldable chair without affecting its usual compact size and/or its folding mechanism.

For example, there exist foldable chairs in which a side table is foldably attached to a seat frame so that a user is able to use the side table for, say, writing purposes. This kind of foldable tables has widely been used in schools, where classrooms with limited space are used to conduct classes for many students. In those circumstances, foldable chairs are spacedly positioned in the classrooms and student sitting on the foldable chairs may unfold the side table and put their books and stationary on the side tables. The disadvantages of such foldable chairs is that when they are not in use, the chairs, although foldable, cannot be reduced to compact size and therefore are difficult to store or transport.

From the above description, one can appreciate the inherent tension between the foldability and portability of foldable chairs on one hand, and the benefits of adding a side accessory on the other. The technical problem is that adding anything like a side table onto a foldable chair would inevitably hinder the folding ability or portability of that foldable chair. This is something which has not been successfully resolved.

SUMMARY OF THE PRESENT INVENTION

A main object of the present invention is to provide a foldable chair comprising a side accessory arrangement in which a side accessory is capable of sliding from underneath a seat frame for supporting an accessory object.

Another object of the present invention is to provide a foldable chair comprising a side accessory which is arranged to hide underneath a seat frame when it is not in use, and to extend sidewardly from the foldable chair when it is needed to support user's accessory.

Another object of the present invention is to provide a foldable chair comprising a side accessory arrangement, which does not hinder the folding operation of the foldable chair so as to allow the foldable chair to retain at its compact size and optimal portability when it is folded.

Another object of the present invention is to provide a foldable chair comprising a side accessory arrangement, which does not interfere with the original mechanical structure of the seat frame and the leg frame. As a result, the manufacturing cost of the present invention for current foldable chair manufacturers can be minimized.

Accordingly, in order to accomplish the above objects, the present invention provides a foldable chair, comprising:

a seat frame for supporting a user to sit on the foldable chair;

a leg frame comprising a plurality of supporting legs pivotally connected with each other and the seat frame for moving between a folded position and an unfolded position, wherein in the folded position, the supporting legs and the seat frame are folded toward each other for forming a compact structure, wherein in the unfolded position, the supporting legs are pivotally unfolded to extend to define a receiving cavity between the supporting legs underneath the seat frame, and to support the seat frame at a position above the leg frame; and a side accessory arrangement, which comprises:

a sliding frame provided on the leg frame at a position underneath the seat frame; and a side accessory coupled with the sliding frame, and is arranged to slide between an idle position and an operation position when the leg frame is in the unfolded position, wherein in the idle position, the side accessory is inwardly slid with respective to the leg frame through the sliding frame to hide in the receiving cavity, wherein in the operation position, the side accessory is outwardly slid from the receiving cavity with respective to the leg frame through the sliding frame for allowing a user to put an object on the side accessory.

These and other objectives, features, and advantages of the present invention will become apparent from the following detailed description, the accompanying drawings, and the appended claims.

DETAILED DESCRIPTION OF THE PREFERRED EMBODIMENT

Figure 1:
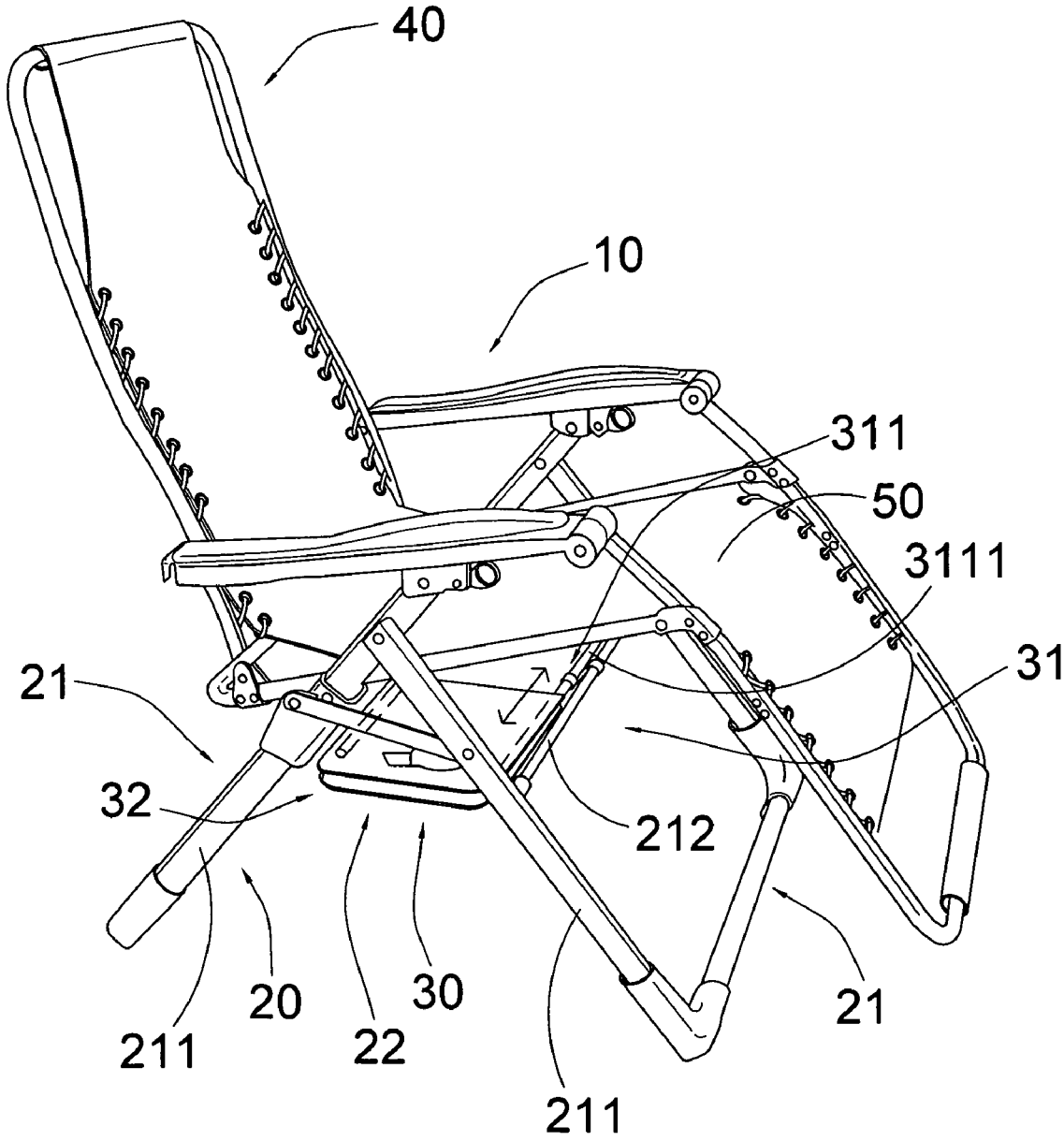
FIG. 1 is a perspective view of a foldable chair according to a preferred embodiment of the present invention.

Referring to FIG. 1 to FIG. 4 of the drawings, a foldable chair according to a preferred embodiment of the present invention is illustrated, in which the foldable chair comprises a seat frame 10 for supporting a user to sit on the foldable chair, a leg frame 20, and a side accessory arrangement 30.

The leg frame 20 comprises a plurality of supporting legs 21 pivotally connected with each other and the seat frame 10 for moving between a folded position and an unfolded position, wherein in the folded position, the supporting legs 21 and the seat frame 10 are folded toward each other for forming a compact structure, wherein in the unfolded position, the supporting legs 21 are pivotally unfolded to extend to define a receiving cavity 22 between the supporting legs 21 underneath the seat frame 10, and to support the seat frame 10 at a position above the leg frame 20.

The side accessory arrangement 30 comprises a sliding frame 31 and a side accessory 32. The sliding frame 31 is provided on the leg frame 20 at a position underneath the seat frame 10.

On the other hand, the side accessory 32 is coupled with the sliding frame 31, and is arranged to slide between an idle position and an operation position when the leg frame 20 is in the unfolded position, wherein in the idle position (FIG. 2), the side accessory 32 is inwardly slid with respective to the leg frame 20 through the sliding frame 31 to hide in the receiving cavity 22, wherein in the operation position (FIG. 3), the side accessory 31 is outwardly slid from the receiving cavity 22 with respective to the leg frame 20 through the sliding frame 31 for allowing a user to put an object on the side accessory 31.

According to the preferred embodiment of the present invention, the foldable chair further comprises a back frame 40 upwardly extended from the seat frame 10 for supporting a back portion of the user. Moreover, the foldable chair further comprises a seat element 50 attached on the seat frame 10 for allowing a user to seat thereon. The seat element 50 may be a seat fabric or a seat cushion attached on the seat frame 10 for allowing the user to comfortably sit on the seat fabric or the seat cushion.

Figure 2:
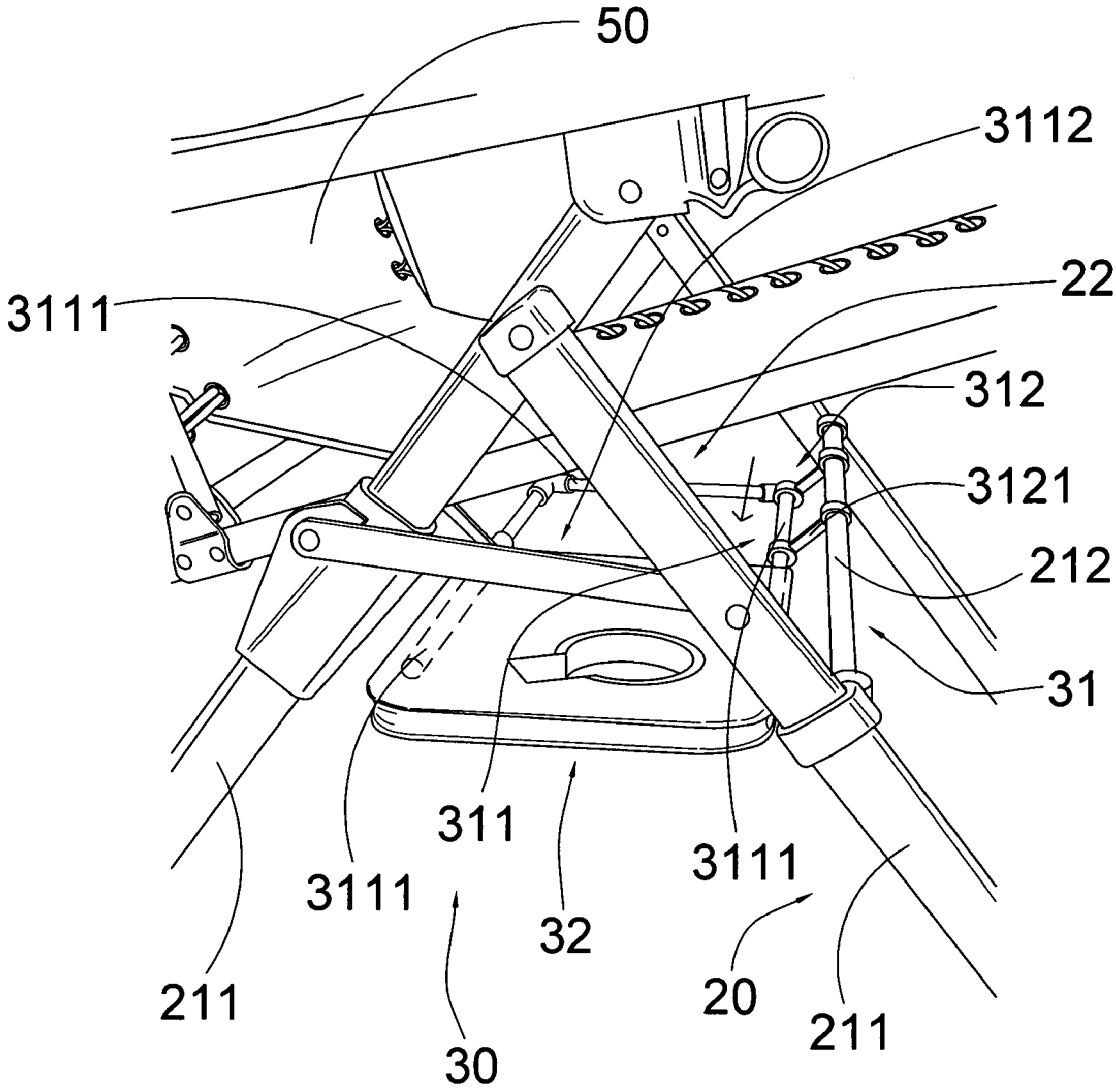
FIG. 2 is an exploded perspective view of a foldable chair according to the above preferred embodiment of the present invention.
Figure 3:
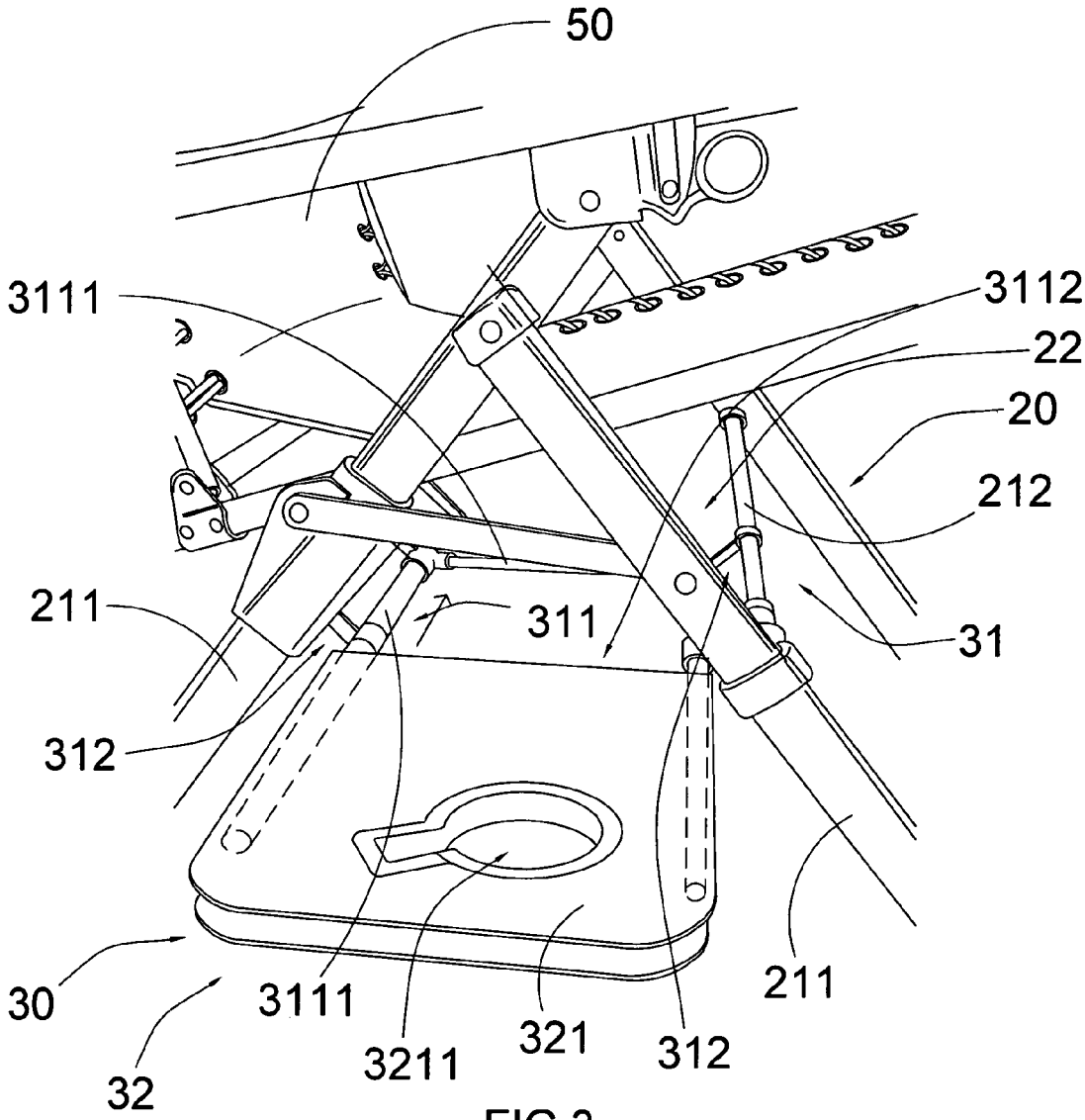
FIG. 3 is a schematic diagram of a foldable chair according to the above preferred embodiment of the present invention.

As shown in FIG. 1 to FIG. 3 of the drawings, each of the supporting legs 21 comprises a plurality of elongated leg members 211 and a transverse supporting member 212 extended across the elongated leg members 211 to form a substantially "H" structure. There are altogether two supporting legs 21 in this particular embodiment of the foldable chair (a front supporting leg 21 and a rear supporting leg 21). That means there are altogether four elongated leg members 211 and two transverse supporting members 212. Each of the leg members 211 of the front supporting leg 21 is pivotally connected with the corresponding leg member 211 of the rear supporting leg 21 so that the two supporting legs 21 are pivotally connected with each other to move between the folded position and the unfolded position. It is worth mentioning that when the leg frame 20 is in the unfolded position, the receiving cavity 22 is formed at a space between the two supporting legs 21, preferably underneath the transverse supporting members 212.

The sliding frame 31 of the side accessory arrangement 30 comprises an accessory frame 311 for coupling with the side accessory 32, and a slider frame 312 slidably connecting the accessory frame 311 with the corresponding supporting legs 21. More specifically, the slider frame 312 comprises a plurality of sliding members 3121 extended from the accessory frame 311 to slidably couple with the transverse supporting members 212 of the supporting legs 21 respectively so that the sliding members 3121 are capable of sliding along the transverse supporting members 212. When the sliding members 3121 slide along the transverse supporting members 212, the accessory frame 311 is also driven to slide in and out of the receiving cavity 22.

The accessory frame 311 is shaped and sized to correspond with the particular embodiment of the side accessory 32. More specifically, the accessory frame 311 comprises a plurality of frame members 3111 connected to form a frame platform 3112 for supporting the side accessory 32. As shown in FIG. 2 to FIG. 3 of the drawings, each of the frame members 3111 is elongated in shape to form a quadrilateral cross section, wherein the side accessory 32 is coupled with one edge portion of the frame platform 3112 at the corresponding frame members 3111.

Each of the sliding members 3121 is also elongated in shape and has one end portion connected with one of the frame members 3111 of the accessory frame 311, and another end portion slidably connected with the transverse supporting member 212 in such a manner that when the accessory frame 311 (or the side accessory 32) is horizontally displaced, the sliding members 3121 are also driven to slide along the transverse supporting member 212 so as to allow the side accessory 32 to slide in and out of the receiving cavity 22.

Figure 4:
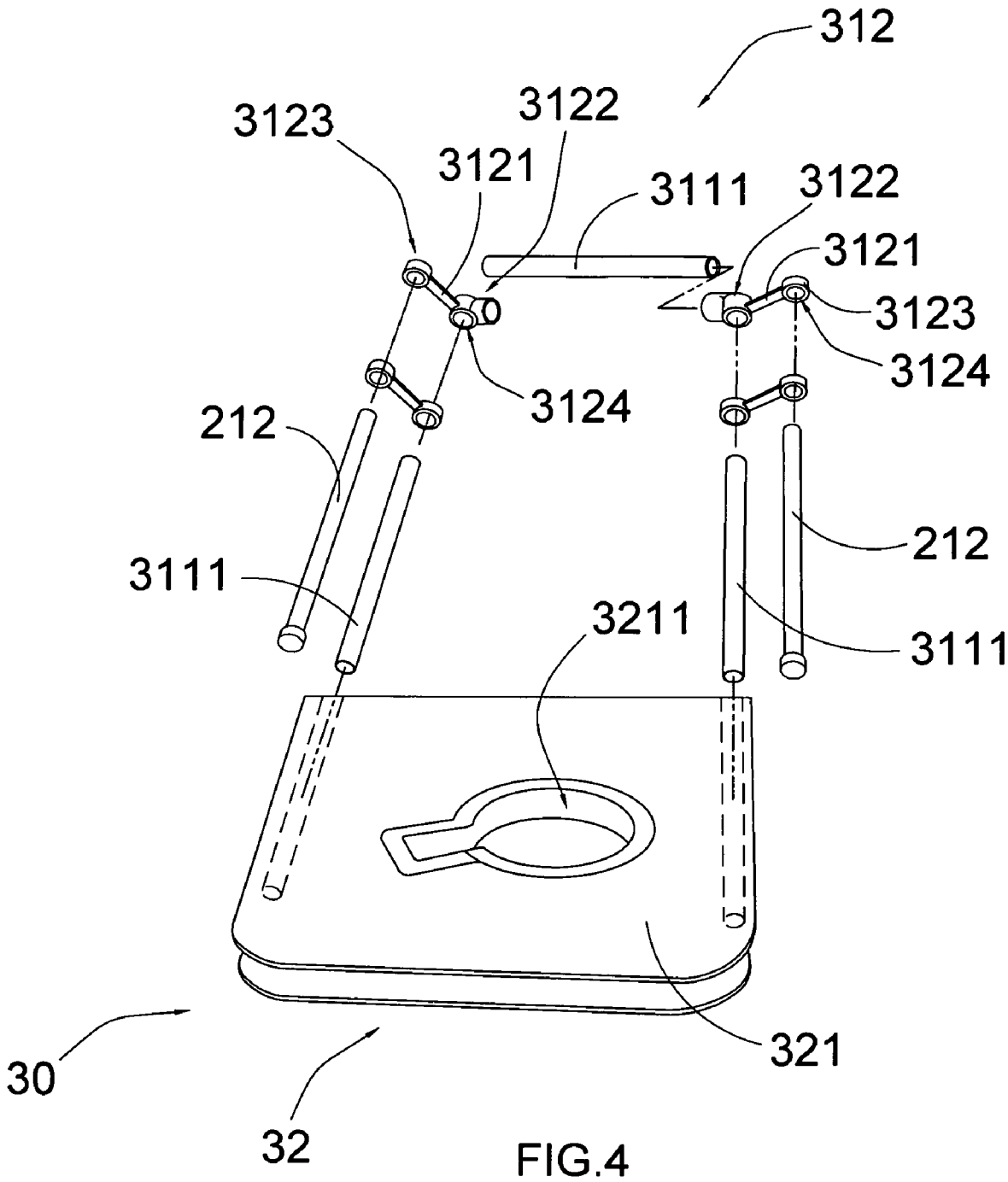
FIG. 4 is a partially perspective view of the foldable chair according to the above preferred embodiment of the present invention.

As shown in FIG. 4 of the drawings, each of the sliding members 3121 has a securing end 3122 securely connected with one of the frame members 3111, a slider end portion 3123 slidably connected with the transverse supporting member 212. The slider end portion 3123 of each of the sliding members 3121 has an enlarged tubular structure to form a sliding slot 3124, wherein the transverse supporting member 212 is arranged to pass through the sliding slot 3124 so that the sliding member 3121 slidably connects the accessory frame 311 with the transverse supporting member 212.

According to the preferred embodiment of the present invention, the side accessory 32 comprises a side table panel 321 having two side edge portions coupled with the two corresponding frame members 3111 of the accessory frame 311 such that when the accessory frame 311 is slid along the transverse supporting member 212, the side table panel 321 also slides with respective to the transverse supporting member 212 for moving between the idle position and the operation position (as mentioned above).

The side table panel 321 further has a cup slot 3211 as a utility slot indently formed therein for allowing the user to put a cup of an appropriate size into the cup slot 3211. It is important to mention that the side accessory 32 can also be embodied as other accessories for a foldable chair so that the present invention can have a wide range of applications.

The operation of the present invention is as follows: the foldable chair is normally folded at the folded position for easy storage and transportation. When a user wishes to use the foldable chair, he or she needs to unfold the foldable chair by extending the foldable chair to the unfolded position. The user may then sit on the foldable chair for enjoyment. When he or she needs to put some accessories near the foldable chair, he or she may take out the side accessory 32 by pulling it from the receiving cavity 212 (i.e. moving the side accessory 32 from the idle position to the operation position). The user may then be able to put some personal accessories or drinks etc. on the side accessory 32. When the user finishes using the personal accessory, he or she may slidably push the side accessory 32 back to the receiving cavity 212 for putting the side accessory 32 to return to the receiving cavity 212.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A foldable chair, comprising:

a seat frame for supporting a user to sit on said foldable chair;

a leg frame comprising a plurality of supporting legs pivotally connected with each other and said seat frame for moving between a folded position and an unfolded position, wherein in said folded position, said supporting legs and said seat frame are folded toward each other for forming a compact structure, wherein in said unfolded position, said supporting legs are pivotally unfolded to extend to define a receiving cavity between said supporting legs underneath said seat frame, and to support said seat frame at a position above said leg frame, wherein each of said supporting legs comprises a plurality of elongated leg members and a transverse supporting member extended across said elongated leg members to form a substantially "H" structure, wherein each of said leg members of one of said supporting legs is pivotally connected with said corresponding leg member of another of said supporting legs so that said two supporting legs are pivotally connected with each other to move between said folded position and said unfolded position, wherein when said leg frame is in said unfolded position, said receiving cavity is formed at a space between said two supporting legs underneath said transverse supporting members; and a side accessory arrangement, which comprises:

a sliding frame provided on said leg frame at a position underneath said seat frame; and a side accessory coupled with said sliding frame, and is arranged to slide between an idle position and an operation position when said leg frame is in said unfolded position, wherein in said idle position, said side accessory is inwardly slid with respective to said leg frame through said sliding frame to hide in said receiving cavity, wherein in said operation position, said side accessory is outwardly slid from said receiving cavity with respective to said leg frame through said sliding frame for allowing a user to put an object on said side accessory, wherein said sliding frame of said side accessory arrangement comprises an accessory frame for coupling with said side accessory, and a slider frame slidably connecting said accessory frame with said corresponding supporting legs, wherein said slider frame comprises a plurality of sliding members extended from said accessory frame to slidably couple with said transverse supporting members of said supporting legs respectively so that when said sliding members are capable of sliding along said transverse supporting members, and when said sliding members slide along said transverse supporting members, said accessory frame is also driven to slide in and out of said receiving cavity.

2. The foldable chair, as recited in claim 1, wherein further comprising a back frame upwardly extended from said seat frame for supporting a back portion of said user, and a seat element attached on said seat frame for allowing a user to seat thereon.

3. The foldable chair, as recited in claim 1, wherein said side accessory comprises a side table panel having two side edge portions coupled with said accessory frame such that when said accessory frame is slid along said transverse supporting member, said side table panel also slides with respective to said transverse supporting member for moving between said idle position and said operation position.

4. The foldable chair, as recited in claim 3, wherein said side table panel further has a utility slot indently formed therein.

5. The foldable chair, as recited in claim 1, wherein each of said sliding members is elongated in shape and has one end portion connected with one of said frame members of said accessory frame, and another end portion slidably connected with said transverse supporting member in such a manner that when said accessory frame is horizontally displaced, said sliding members are also driven to slide along said transverse supporting member so as to allow said side accessory to slide in and out of said receiving cavity.

6. The foldable chair, as recited in claim 5, wherein each of said sliding members has a securing end securely connected with one of said frame members, a slider end portion slidably connected with said transverse supporting member, wherein said slider end portion of each of said sliding members has an enlarged tubular structure to form a sliding slot, wherein said transverse supporting member is arranged to pass through said sliding slot so that said sliding member slidably connects said accessory frame with said transverse supporting member.

7. The foldable chair, as recited in claim 6, wherein said side accessory comprises a side table panel having two side edge portions coupled with said corresponding frame members of said accessory frame such that when said accessory frame is slid along said transverse supporting member, said side table panel also slides with respective to said transverse supporting member for moving between said idle position and said operation position.

8. The foldable chair, as recited in claim 7, wherein further comprising a back frame upwardly extended from said seat frame for supporting a back portion of said user, and a seat element attached on said seat frame for allowing a user to seat thereon.

9. The foldable chair, as recited in claim 7, wherein said side table panel further has a utility slot indently formed therein.

10. The foldable chair, as recited in claim 9, wherein further comprising a back frame upwardly extended from said seat frame for supporting a back portion of said user, and a seat element attached on said seat frame for allowing a user to seat thereon.

11. The foldable chair, as recited in claim 1, wherein said accessory frame comprises a plurality of frame members connected to form a frame platform for supporting said side accessory, wherein each of said frame members is elongated in shape to form a quadrilateral cross section, wherein said side accessory is coupled with at least one edge portion of said frame platform at said corresponding frame members.

12. The foldable chair, as recited in claim 11, wherein said side accessory comprises a side table panel having two side edge portions coupled with said accessory frame such that when said accessory frame is slid along said transverse supporting member, said side table panel also slides with respective to said transverse supporting member for moving between said idle position and said operation position.

13. The foldable chair, as recited in claim 12, wherein said side table panel further has a utility slot indently formed therein.

14. The foldable chair, as recited in claim 11, wherein each of said sliding members is elongated in shape and has one end portion connected with one of said frame members of said accessory frame, and another end portion slidably connected with said transverse supporting member in such a manner that when said accessory frame is horizontally displaced, said sliding members are also driven to slide along said transverse supporting member so as to allow said side accessory to slide in and out of said receiving cavity.

15. The foldable chair, as recited in claim 14, wherein for each of said sliding members, one of said end portions is a securing end securely connected with one of said frame members, and another of said end portions is a slider end portion slidably connected with said transverse supporting member, wherein said slider end portion of each of said sliding members has an enlarged tubular structure to form a sliding slot, wherein said transverse supporting member is arranged to pass through said sliding slot so that said sliding member slidably connects said accessory frame with said transverse supporting member.

16. The foldable chair, as recited in claim 15, wherein said side accessory comprises a side table panel having two side edge portions coupled with said corresponding frame mem bers of said accessory frame such that when said accessory frame is slid along said transverse supporting member, said side table panel also slides with respective to said transverse supporting member for moving between said idle position and said operation position.

17. The foldable chair, as recited in claim 16, wherein said side table panel further has a utility slot indently formed therein.

* * * * *